US007883294B1

(12) United States Patent
Licina

(10) Patent No.: US 7,883,294 B1
(45) Date of Patent: Feb. 8, 2011

(54) MONOLITHIC DOCK AND METHOD FOR MAKING

(76) Inventor: Wayne Charles Licina, P.O. Box 2686, Sausalito, CA (US) 94966

( * ) Notice: Subject to any disclaimer, the term of this patent is extended or adjusted under 35 U.S.C. 154(b) by 435 days.

(21) Appl. No.: 11/888,369

(22) Filed: Jul. 31, 2007

(51) Int. Cl.
*B63B 3/00* (2006.01)

(52) U.S. Cl. ..... 405/218; 405/219; 114/263; 114/264

(58) Field of Classification Search ..... 405/4, 405/5, 218, 219; 114/263, 264; 264/46.4, 264/46.5
See application file for complete search history.

(56) References Cited

U.S. PATENT DOCUMENTS 3,634,898 A * 1/1972 Geiger ..... 114/357
3,752,102 A * 8/1973 Shuman ..... 114/267
4,318,361 A * 3/1982 Sluys ..... 114/263
6,026,760 A * 2/2000 Phillips et al. ..... 114/267

FOREIGN PATENT DOCUMENTS

GB 2266326 A * 10/1993

* cited by examiner

*Primary Examiner*—David J Bagnell
*Assistant Examiner*—Benjamin Fiorello
(74) *Attorney, Agent, or Firm*—Risto A. Rinne, Jr.

(57) ABSTRACT

An apparatus for providing a floating type of a boat dock or platform includes a plurality of synthetic material decking members that are disposed along the sides and top of the dock. Urethane foam is applied to an interior of the apparatus and it expands to fill the interior voids while simultaneously securing the decking members proximate one-another by securing them to the urethane foam. Accordingly, a monolithic structure is provided without the use of fasteners. Corner members are used that extend around an upper perimeter of the dock. Side members are used to form the sides, ends, and the decking material that forms an upper surface. An optional rounded member is preferably used at the bottom along a perimeter of the apparatus. Optional features, including elastomeric coating, filler blocks, utility conduits, sunken vaults, cleats, upper decking surface and waterline heating are also described.

7 Claims, 7 Drawing Sheets

MONOLITHIC DOCK AND METHOD FOR MAKING

BACKGROUND OF THE INVENTION

1. Field of the Invention

The present invention, in general, relates to aquatic structures and, more particularly, to floating, fixed-in-place docks that are used to moor boats.

There are known types, of structures that are similar but different than docks. They are called piers. These types of structures are fixed in position with a portion of the structure disposed over water and at an elevation that is greater than the highest anticipated water level. Because these structures are fixed in position relative to the earth, they do not float. Accordingly, they do not provide a surface that maintains itself a fixed distance above a surface of the water. This is essential for a dock to moor boats. Accordingly, piers are not generally suitable for use as a dock to moor boats (vessels).

Docks, in general, are well known types of structures that are used to moor boats that vary in size from kayaks to large yachts. They are disposed on the water and secured on the horizontal plane where they float. They are generally secured along both an X axis and a perpendicular Y axis relative to the earth. Because docks float they rise and fall along a vertical, or Z axis in accordance with changes in the water level. These changes are brought about by changes in the tide and by many other factors, such as the balance of inflow and outflow of water into lakes and rivers, as well as wave action and loading.

The X axis, for the description herein, is perpendicular to and extends away from the shoreline. The Y axis is parallel with respect to the shoreline. Both the X and the Y axis are on a horizontal plane. The Z axis is on a vertical plane.

As such docks provide an upper surface that remains a fixed distance above the surface of the water that they are disposed on. Therefore, boats are able to pull up alongside the dock and secure (i.e., tie) the boat to the dock. People are then able to embark (i.e., leave the dock and board the boat) or disembark (i.e., leave the boat and step back onto the dock). The dock therefore serves as an intermediate structure to allow access to and from the boat with respect to the shore.

For small applications, such as a private dock for one or a few boats, a single section of dock is often used. A typical dock section includes a width of several feet and a length from about fifteen to well over twenty feet long. Wider and longer dock sections are also known.

For larger applications, a plurality of dock sections are secured together in a preferred pattern. Sometimes, a plurality of dock sections are attached together in a linear arrangement. This allows for access to water that is further away from the shoreline and presumably deeper. Sometimes, a plurality of dock sections are attached together, usually by a hinge, and form a main section of dock. From the main section other shorter sections are secured at one end, usually by a hinge to the main section, and branch off in a perpendicular direction. Generally, docks systems are built to provide a maximum amount of dock perimeter (for boats to moor) while encompassing a minimum amount of surface area. Docks systems are also sized to accommodate the size of boats that are expected to be moored.

To consider how a dock is maintained in place, consider a simple single section type of dock that extends away from the shoreline in the X axis. The dock is fixed in place along both the X and Y axes at a first end that is proximate the shoreline and at a second end that is disposed away from the shoreline. There are numerous ways of accomplishing this.

A common way is to hingedly attach the first end to a structure that is anchored or otherwise secured to the ground (i.e., shoreline). Typically, a hinge is used at the first end to anchor the dock to the structure. The hinge allows the dock to pivot about a hinge axis in response to wave action.

The first end of the dock must also be able to move relative to the water in a vertical direction along the Z axis. Either the first end of the dock is able to rise and fall freely on the Z axis or it is secured to a type of structure that is able to rise and fall in response to changes in water level.

To secure the dock at the second end, most commonly either a vertical hole (that may be reinforced with a pipe lining) is provided through the dock or, alternately, a three-eighths inch galvanized plate with a horizontal ring attached thereto is secured to the dock. When the hole passes through the dock it is known as a "spud well". When the ring is attached to the dock the ring is disposed off to the side of the dock and is known as a "pile guide". The pile guide is attached where needed for a pile (i.e., a vertical pipe) to pass through.

The vertical pipe (or pile) is driven into the earth that is disposed under the water. The pipe (or pile) extends up above the highest anticipated water level and passes through the spud well or pile guide.

Accordingly, the dock is secured in position along both the X and Y axes and is able to rise and fall along the Z axis. If the structure that is disposed at the first end of the dock does not rise and fall along the Z axis, then the first end of the dock can include a pile to secure it in position and allow it to rise and fall.

Although more than one spud well can be used per dock section, it is common practice to secure the first end of the dock to the structure and use the pile (passing through the spud well or through the pile guide) to secure the second end of each dock section. A plurality of piles may be used to secure the main section in position, as desired.

Each branch section is typically hingedly attached to the main section and secured at a distal end by a pile. Most branch sections are perpendicular with respect to the main section, although there is no mandate that they be configured in that manner. Accordingly, any desired size of a dock system (assembly) can be provided. If desired, additional branch sections can also branch off from the branches to create even more elaborate dock systems.

The first end of the dock is attached to the structure in a variety of ways. One such method includes an intermediate ramp that is hingedly attached at a first ramp-end to the main structure and which is attached at an opposite end of the ramp to the first end of the dock, usually with wheels or rollers that accommodate changes in elevation of the dock. The main structure will typically include a walkway that is above the highest anticipated water line and which ultimately extends to terra firma. The first ramp-end provides access to the walkway. The first ramp-end and walkway are disposed above the highest anticipated water level.

Certain types of structures to which the dock may be attached are also adapted to rise and fall (i.e. float) in response to changes in the water level. One such type of floating structure is attached to a track. The track is attached to a sloping surface that extends from above the highest anticipated water level down into the water below the lowest anticipated water level.

As the water level rises, the structure is urged upward along the track. When the water level falls, the structure descends down the track. Accordingly the dock, which is hingedly attached to the structure, is able to move both upward and downward in response to changes in water level.

As the dock moves up or down, the dock exerts a force on the structure that causes it to correspondingly move up or down along the track. Therefore, it is the motion of the dock in the Z axis that supplies the force necessary to position the structure along the track.

With this type of arrangement, the dock is retained in position along the Y axis by the hinge. However, as the dock rises and falls it also moves in and out along the X axis as the structure moves up and down and follows the slope of the track. Accordingly, this type of a dock cannot be secured by a spud. Its use is generally limited to applications requiring a shorter dock length and for lighter duty applications. This is because the hinge cannot withstand an excessive loading of the dock along the Y axis. Therefore, this type of structure is not used to secure the dock where strong currents and excessive side loading is anticipated.

There are several common types of docks. A high-end dock includes a concrete deck over foam floatation that is encased in concrete. These types of docks are very heavy and therefore require maximum draft. Accordingly, they are not well-suited for use in strong cross-currents or if the water is likely to freeze. They, being heavy, are difficult to transport and generally, must be made near the site where they will be used.

Accordingly, a great deal of custom design and assembly is required to make the necessary forms, add reinforcing to the concrete, pour the concrete, insert the foam floatation, protect the foam flotation from damage, and then move the dock into position. Also, they are not especially attractive to view. Concrete docks are durable. However, they are very expensive to manufacture, transport, and install.

The most common type of dock includes a fabricated wooden frame over styrene (foam) blocks or billets. These docks are commonly custom made for each application. A very large inventory of materials is required that includes the lumber and fasteners. Each board is cut to size and fastened.

This type of dock can be manufactured to the preferred size, in accordance with the lumber that is available. However, wood docks have many disadvantages.

First, while their appearance is at first minimally acceptable, they soon bleach and begin to discolor. Aesthetically, wood docks have a short life expectancy. General decay and deterioration of the dock soon begins.

The appearance of this (and other types of docks that use billets for floatation) type of dock is affected by the floatation. The wooden frame is suspended by the floatation above the waterline. A space between a bottom of the wooden frame and water exists. This space is unsightly and can allow viewing of unsightly billets under the dock. Because this type of dock is so common and because no other aesthetically pleasing solution has been found, people have become somewhat accustomed to the appearance of these unsightly billets. Ideally, the siding of a dock would extend below the waterline, thereby eliminating the space and the billets from view.

Because the wood frame is elevated above the water a space is provided under the dock for oxygen (air). If a fire starts on the wooden portion, air is drawn in from under the dock and it feeds the flames. Accordingly, wooden docks are susceptible to fire. If the siding of the dock extended down below the waterline, air could not be drawn in to feed a fire on the surface of the dock. This would retard its spread.

The elevated design of wooden docks also permits the wind to pass under the dock. In extreme conditions with especially high winds these types of docks can be lifted by the wind and damaged.

Also, these types of docks experience a great deal of torsional (twisting) movement along their longitudinal length. This occurs from wave action as well as from loading. When a person steps on any dock when disembarking from a boat, the load is placed on an outside perimeter of the dock. This causes a torsional loading that twists the dock along its longitudinal length. Wave action also produces a torsional loading and unloading cycle.

While all docks experience torsional loading, wood docks lack stiffness and experience an excessive amount of twisting. This makes the dock feel less secure when a person steps near to its perimeter. This is because that portion of the dock descends a disproportionate amount while the remainder remains more afloat. The feeling this produces is of instability and a lack of certainty of footing. This is felt most commonly when stepping near the edge, such as when boarding or disembarking from a vessel. The resistance to movement is known as transverse stability. It is desirable that a dock experience minimum movement during use and therefore possess maximum transverse stability.

When a wave passed under a dock and is disposed near a longitudinal center thereof, the center of the dock is raised while the outside ends of the dock are unsupported. This causes the dock to flex downward at the ends. This is known as "hog" in the marine arts.

When two waves support the outside ends of a dock, the center of dock is unsupported and it sags. This is known as "sag" in the marine arts. The resistance to sag is dependant upon the stiffness of the dock. It is desirable that a dock have minimum sag, (i.e., maximum stiffness).

Ideally, a dock should be as stiff as possible, with minimum hog, sag, and twisting occurring.

In summary, hog, sag, and torsional loading subject all docks to loading and unloading cycles that stress the dock in all axes. Wood types of docks are especially prone to rapid deterioration. Accordingly, wood docks begin to lose stiffness quickly because the fasteners that secure the members together concentrate the loading and unloading forces and deform the wood. As the components expand, contract, or twist these movements are arrested by the fasteners that secure them together.

In other words, the repeated cycles of transverse (torsional) and longitudinal loading as well as expansion and contraction focus all of the forces on the fasteners. This causes the holes in which the fasteners engage to continually enlarge. The dock begins to experience increasing movement which, in turn, further exacerbates the process. This soon leads to the inevitable deterioration and general wearing away of the prior art type of wooden dock.

Wooden docks are also quite heavy and are not suited to transport. Therefore, they are generally assembled in-situ. Additionally, when a change in dock design or dimension is required, a completely new set of plans are required and a new list of materials (LM) is required. Additionally, it takes a very long time to cut each member and fasten them together. The time of assembly and therefore the cost is high.

An appendix, attached hereto, provides a comparison of the list of materials between a comparable wood dock and the instant monolithic dock. This provides a ready visual indication as to the complexity of manufacture, the increased inventory of materials, and the custom design nature of wood docks as compared to the instant invention.

Also, some docks are used in bodies of water that can freeze. The expansion of the ice is especially destructive to virtually all existing types of docks. This is because most existing types of docks are relatively heavy for their size. Accordingly, a great deal of draft (i.e., depth of the dock in the water) is required. This places a significant amount of the dock in the water exactly at the level where the water is prone to freeze and therefore damage the dock.

When a prior art type of dock that requires substantial draft (i.e., several inches to well over a foot) is in water that freezes, it is virtually impossible for the dock to be urged up out of the water and on top of the ice as it freezes. Accordingly, the ice exerts great pressure on the side walls of the dock, crushing the dock.

Also, prior art types of dock generally have vertical sidewalls. When the water freezes with such a type of dock there is no vertical or uplifting force that is exerted on the dock. It is desirable for a dock that is disposed in the water to be urged up and out of the water as the water freezes. Because of the draft required and the vertical sidewalls of existing prior art docks, this has not heretobefore been possible to accomplish.

There are numerous other problems that have plagued prior art types of docks, either increasing cost and time of manufacture or decreasing reliability and life expectancy.

For example, it has been difficult to create sufficiently strong spud wells with prior art types of docks. Similarly, it has been difficult to include the ducting (i.e., conduit) for utility routing with prior art types of docks. It has also been difficult to provide access areas to the utilities, known as "sunken vaults" with prior art types of docks.

Also, the greater mass and size, and therefore the higher center of gravity of prior art types of docks makes them more prone to tipping or worse yet, tipping over if sufficient side (transverse) loading is applied. It is desirable to make a dock as light as possible and with as low a center of gravity as possible.

The most common prior art types of docks use spaced apart billets to float the dock. This detracts from stability. Accordingly, the floatation element (i.e., the billets) are disposed deeper in the water where they are at greater risk for damage from freezing.

Also, the billets are disposed inward from the edges and generally toward the longitudinal center of prior art types of docks. This provides less floatation near to the edges of the dock which, in turn, detracts from transverse (i.e., roll) stability.

Accordingly, these types of docks are less safe and feel less comfortable to walk on. Standing on an edge of five foot wide, free floating wood dock with foam floatation might cause the edge to sink an additional six to seven inches in the water. By comparison, a comparably sized monolithic dock with similar loading would only sink from about two to three inches at the edge.

For the purpose of comparison, a wooden sixteen foot long by six foot wide dock might weigh about 1600 pounds with a draft of five to six inches and have a total residual buoyancy (net load) of about 1600 pounds. A similar size concrete dock might weigh about 6000 pounds with a draft of about eighteen inches and have a residual buoyancy of about 2200 pounds. However, a comparable size monolithic dock would weigh approximately 900 pounds, draft around 1 inch, and have a residual buoyancy of about 5000 pounds. It is desirable for a dock to have a lower weight and a greater residual buoyancy.

It is also desirable to be able to provide the above-mentioned features and benefits in docks that are sized for specific applications. For example, a typical size monolithic dock designed for use with kayaks and other low to the water vessels would include a length of twenty feet and a width of five feet and a depth of about five and three-quarter inches. Even so, it would include a draft that is one inch or less and be able to support (i.e., float) approximately three-thousand pounds. This low of a draft and this high of a loading have previously been unavailable for such a comparably small-sized dock. Obviously, with a height that is less than six inches, the dock would have a very low center of gravity, also previously unavailable.

Accordingly, there exists today a need for a monolithic dock that helps to ameliorate the above-mentioned problems and difficulties as well as ameliorate those additional problems and difficulties as may be recited in the "OBJECTS AND SUMMARY OF THE INVENTION" or discussed elsewhere in the specification.

Clearly, such an apparatus would be a useful and desirable device.

2. Description of Prior Art

Docks are, in general, known. While the structural arrangements of the known prior art types of devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a monolithic dock that has a low cost of manufacture.

It is also an important object of the invention to provide a monolithic dock that is aesthetically pleasing.

Another object of the invention is to provide a monolithic dock that is aesthetically pleasing when new and which retains an attractive appearance for an extended period of time.

Still another object of the invention is to provide a monolithic dock that includes less different parts to assemble.

Still yet another object of the invention is to provide a monolithic dock that does not require the use of discreet fasteners to secure one member to another member but which may include them, if desired.

Yet another important object of the invention is to provide a monolithic dock that includes a surrounding shell that partially encloses the dock and which is secured to a core center during assembly.

Still yet another important object of the invention is to provide a monolithic dock that includes a surrounding shell that partially encloses the dock and which includes interior members attached to the shell that engage with a core center.

A first continuing object of the invention is to provide a monolithic dock that includes an exterior siding or decking member that includes interior members that engage with a core center.

A second continuing object of the invention is to provide a monolithic dock that includes an exterior siding or decking member that includes a first row of interior members that engage with a core center at a first distance from the siding or decking member and which includes a second row of interior members that engage with a core center at a second, different distance from the siding or decking member, thereby providing added strength and which may also include a third row of interior members that engage with a core center at a third, different distance from the siding or decking member.

A third continuing object of the invention is to provide a monolithic dock that can be easily modified in size with minimal impact on cost or time to manufacture.

A fourth continuing object of the invention is to provide a monolithic dock that is light in weight.

A fifth continuing object of the invention is to provide a monolithic dock that requires less draft than previous types of docks.

A sixth continuing object of the invention is to provide a monolithic dock that includes a longer life expectancy than previous types of docks.

A seventh continuing object of the invention is to provide a monolithic dock that provides improved torsional stability during loading and unloading.

An eighth continuing object of the invention is to provide a monolithic dock that includes a rounded bottom that minimizes resistance in cross-currents and which also urges the dock upward when the water that it is disposed in freezes.

A ninth continuing object of the invention is to provide a monolithic dock that can withstand use in waters that periodically freeze and thaw.

A tenth continuing object of the invention is to provide a monolithic dock that can easily include utility lines.

An eleventh continuing object of the invention is to provide a monolithic dock that resists infestation.

A twelfth continuing object of the invention is to provide a monolithic dock that can include an inexpensive non-Coast Guard approved filler material and still function effectively.

A fourteenth continuing object of the invention is to provide a monolithic dock that is stiff.

A fifteenth continuing object of the invention is to provide a monolithic dock that includes high roll (transverse) stability.

A sixteenth continuing object of the invention is to provide a monolithic dock that provides floatation support closer to the edge of the dock than previous designs.

A seventeenth continuing object of the invention is to provide a monolithic dock that includes a total residual buoyancy that can be up to five times greater than comparably sized prior art types of docks.

An eighteenth continuing object of the invention is to provide a monolithic dock that can include a low cost filler block of foam.

A nineteenth continuing object of the invention is to provide a monolithic dock that can include an optional layer of elastomeric coating of a portion that is disposed at or below the waterline.

A twentieth continuing object of the invention is to provide a monolithic dock that includes sunken vaults.

A twenty-first continuing object of the invention is to provide a monolithic dock that requires minimal equipment for the manufacture of the monolithic dock.

A twenty-second continuing object of the invention is to provide a monolithic dock that includes a foam core which secures a decking material to the foam core.

A twenty-third continuing object of the invention is to provide a monolithic dock that includes a foam core which is surrounded along its sides and top with a decking material that includes members attached to the decking material that cooperate with the foam core to secure the decking material to the foam core.

A twenty-fourth continuing object of the invention is to provide a monolithic dock that includes a foam core of a predetermined thickness which is sprayed or poured in place and which is surrounded along a portion thereof by a decking material, and wherein the decking material includes members attached thereto that cooperate with the foam core to secure the decking material to the foam core sufficient to provide an integrated section of the monolithic dock subsequent to a curing of the foam core.

A twenty-fifth continuing object of the invention is to provide a monolithic dock that minimizes the magnitude of effect from the shrinkage of foam that occurs during a curing thereof.

A twenty-sixth continuing object of the invention is to provide a monolithic dock that provides an exoskeleton comprised of synthetic decking material.

A twenty-seventh continuing object of the invention is to provide a monolithic dock that provides an exoskeleton that is uniform in appearance and which is comprised of synthetic decking material.

A twenty-eighth continuing object of the invention is to provide a monolithic dock that provides an exoskeleton that includes a synthetic decking material, and wherein the synthetic decking material is visible on the top and sides of the dock, and wherein the synthetic decking material extends down below a water level when the dock is disposed in a body of water, thereby providing a desirable aesthetic appearance.

A twenty-ninth continuing object of the invention is to provide a monolithic dock that, after manufacture, is lightweight.

A thirtieth continuing object of the invention is to provide a monolithic dock that, being sufficiently lightweight, can therefore be manufactured away from where it is intended for use and which can be shipped or otherwise transported to where it is needed for use after it has been manufactured.

Briefly, a monolithic dock that is constructed in accordance with the principles of the present invention has a decking material that is disposed along the sides and top, corner sections that extend around an upper perimeter of the dock, and a foam core that is sprayed in place. The decking and corner sections include generally "T-shaped" members that extend inward toward a center of the dock and which anchor the decking to the foam core. An optional rounded decking is preferably used at the bottom along a perimeter of the dock. Optional features, including elastomeric coating, filler blocks, utility conduits, sunken vaults, cleats, deck and waterline heating are included, as desired.

DETAILED DESCRIPTION OF THE INVENTION

Figure 1:
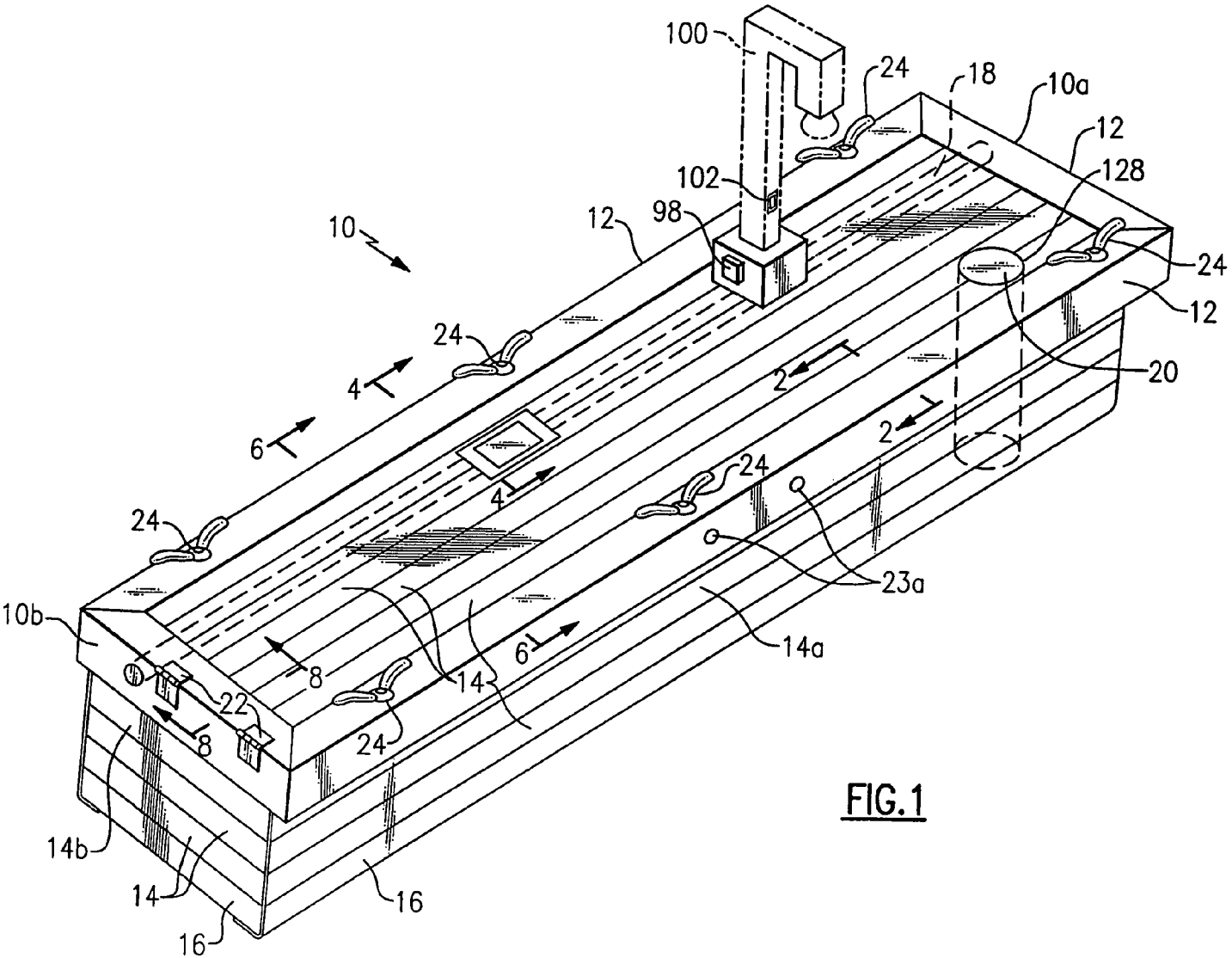
FIG. 1 is a view in perspective of an assembled section of a monolithic dock.

Referring on occasion to all of the drawing figures and now, in particular, to FIG. 1 is shown, a monolithic dock, identified in general by the reference numeral 10. Like elements are identified by like reference numerals in the drawing figures.

The exterior of the monolithic dock 10 is shown as including upper corner members 12 that are used to form an upper and outer perimeter, side members 14 that are used to form vertical siding that is disposed under the corner members 12 and also to form horizontal decking material that is disposed between the corner members 12, and lower J-shaped members 16 that are disposed along the perimeter at the bottom of the monolithic dock 10.

A channel member 18 is disposed where desired as part of the horizontal decking material. The channel member 18 provides two purposes, which are explained in greater detail hereinafter.

A spud well 20 is shown passing through the monolithic dock 10 proximate a first end 10*a* thereof. A pair of hinges 22 is attached on one side thereof to an opposite second end 10*b* of the monolithic dock 10. The hinges 22 are secured to the corner members 12 by any preferred fastener.

Other types of marine dock hinges may also be used. A first portion 23*a* of a type of marine dock hinge 23 (referring now to both FIG. 1 and FIG. 2) passes through a hinge hole 23*b* that is provided through the corner member 12. A pair of nuts 23*c* that cooperate with threads of the first portion 23*a* are tightened and are used to sandwich a pair of plates 23*d* on opposite sides of the corner member 12.

Figure 2:
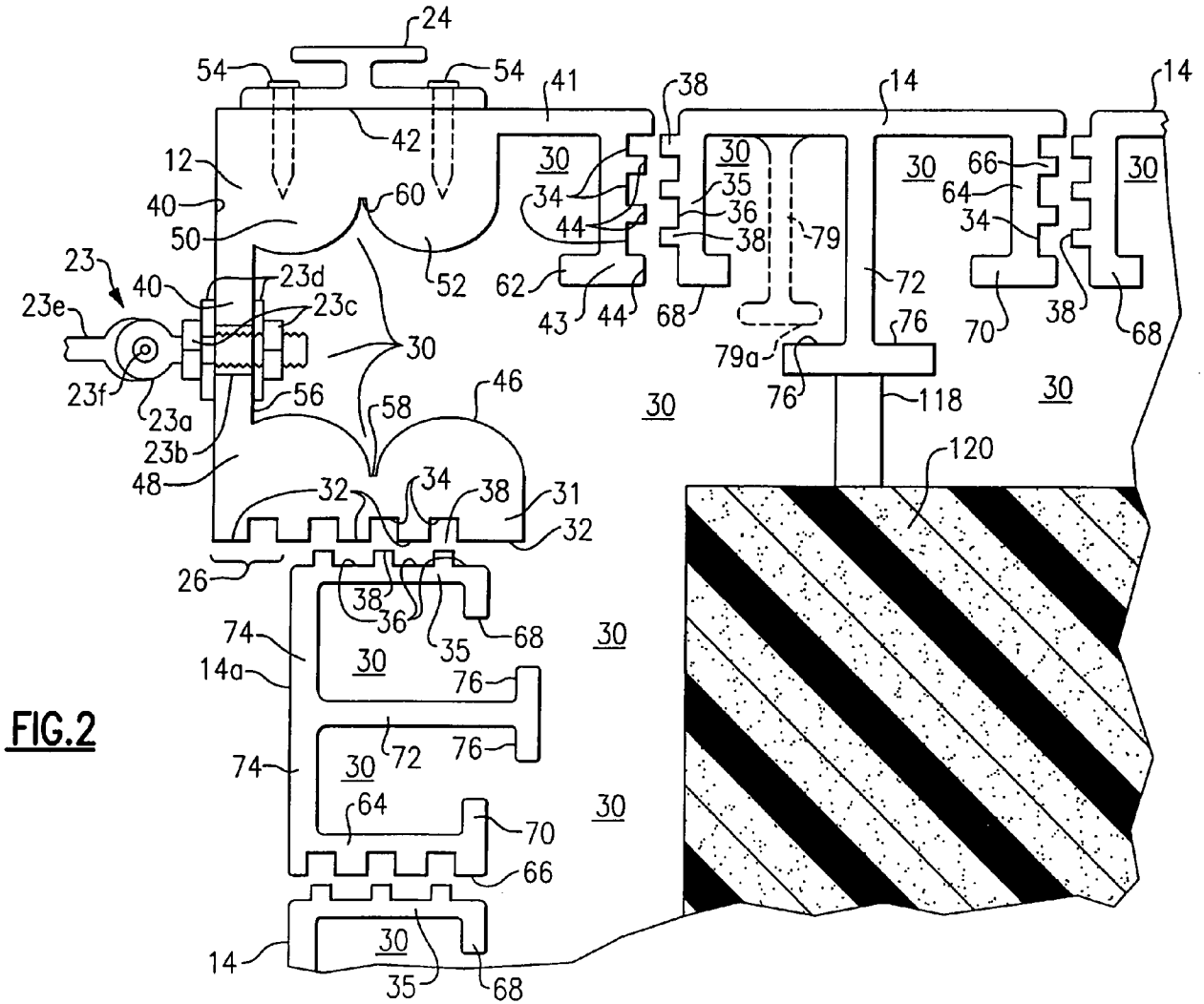
FIG. 2 is a cross-sectional view taken on the line 2-2 in FIG. 1 with the components thereof shown in a slightly exploded view to better illustrate detail of construction.

The marine dock hinge 23, when included, is normally disposed at the second end 10*b* and is used to replace the hinges 22 with a stronger type of hinge mechanism. If additional sections of the monolithic dock 10 (not shown) are included and are intended to branch off at a 90 degree angle (i.e., perpendicular) with respect to the monolithic dock 10 the marine dock hinge 23, or its equivalent, would be used along a side of the monolithic dock 10, as shown in FIG. 1 and FIG. 2.

A pair of the first portions 23*a* (only one is shown) are disposed on the second side 10*b* and are separated from each other by a predetermined distance, for example by a few feet. The plates 23*d* will typically extend fully to include securement to the monolithic dock 10 by both of the first portions 23*a*.

Accordingly, the plate 23*d* that is disposed inside of the monolithic dock 10 acts as an internal structural member (i.e., a member that is disposed on an interior of the monolithic dock 10) that is used to increase structural strength, where desired, by distributing loading forces and stresses over a greater area. The plate 23*d* that is disposed inside of the monolithic dock 10 must be installed and tightened prior to a pouring of a urethane foam (identified by the reference numeral 30 and shown in angled lines). The pouring and curing of the urethane foam 30 is discussed in greater detail hereinafter.

The use of the plate 23*d* inside of the dock 10 illustrates how, when other with types of components that can be used with the monolithic dock 10 are attached to the monolithic dock 10, they may similarly require the inclusion of some type of a modified internal support member (not shown) that is disposed inside of the monolithic dock 10 at the time of its construction (i.e., manufacture).

The plate 23*d* that is disposed on an exterior of the monolithic dock 10 also acts as an external structural member to increase structural strength, where desired, by distributing loading forces and stresses over a greater area. Other types of external structural members can, of course, be used to attach other component parts as may be desired to the monolithic dock 10.

Figure 8:
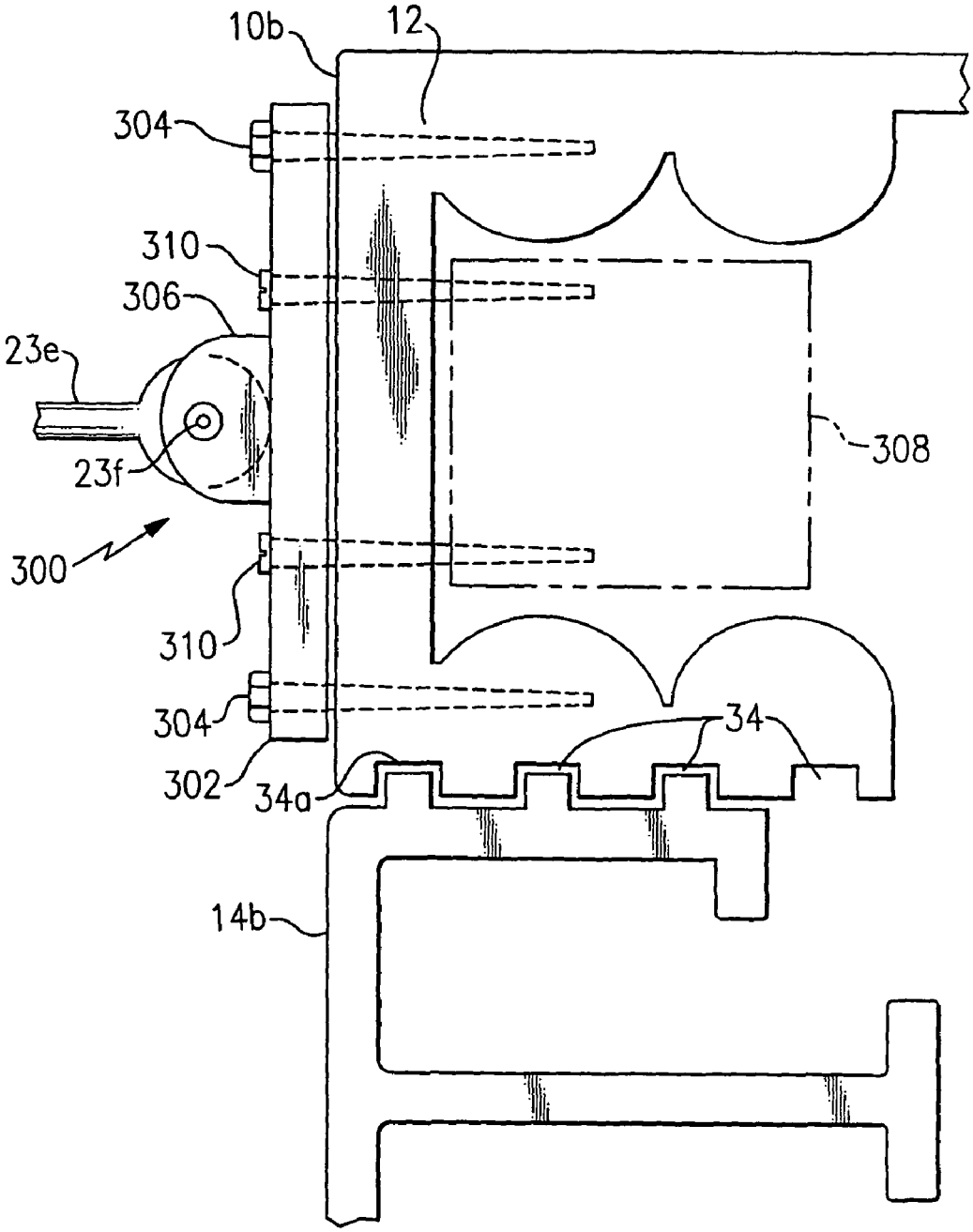
FIG. 8 is a cross-sectional view taken on the line 8-8 in FIG. 1.

A second portion 23*e* of the marine dock hinge 23 is similarly secured to a second section (not shown) of the monolithic dock 10. A rod 23*f* passes through openings provided in the first portion 23*a* and second portion 23*e*, and provides a pivot axis and an especially strong hinge mechanism. The second portion 23*e* may alternately be secured to another fixed in place structure instead of to a second section of the monolithic dock 10. A preferred hinge is shown in FIG. 8 for use at the ends (10*a*, 10*b*) and is described in greater detail hereinafter.

If preferred, the hinges 22 may be used and if so, they are attached to the monolithic dock 10 either by screws that are inserted into the corner members 12 or by bolts that pass through holes provided in the corner members with nuts disposed on an inside of the monolithic dock 10.

A plurality of cleats 24 are attached to the corner members 12, where desired. Cleats 24 are well known devices used to secure a vessel (boat) to the monolithic dock 10.

The corner members 12, side members 14, J-shaped members 16, and channel members 18 are formed of a synthetic material, identical or comparable to that used on a variety of synthetic decking materials that are currently commercially available and which are used to replace wooden boards that are commonly used with decks and porches of homes.

Different manufacturers use different materials and formulations for the synthetic decking products that they produce. In general, most synthetic decking products are intended to replicate the appearance of wood and provide a longer lasting, more durable product.

Most synthetic decking products are formed of a high-density polyethylene (HDPE) material or they are a composite of HDPE and other materials. Certain decking products may include a quantity of wood fiber along with the HDPE. The HDPE can be newly manufactured or recycled material or both, as desired. For the purpose of this disclosure the term "synthetic decking" refers to any structural member having a length, width, and thickness that includes a man-made material, such as HDPE, either alone or in combination with other natural occurring materials.

Figure 3:
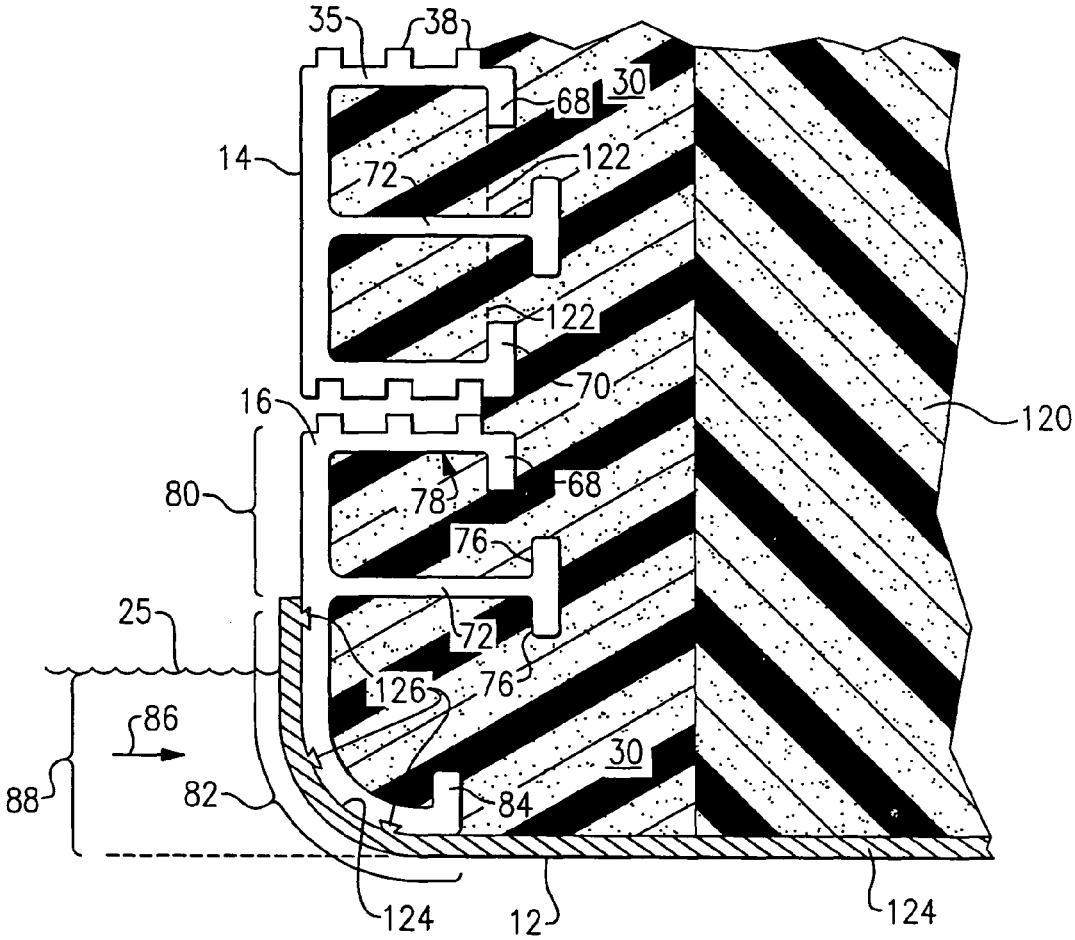
FIG. 3 is a continuation of the cross-sectional view of FIG. 2, continuing lower and thereby showing a lower J-shaped member disposed at a bottom of the monolithic dock.

Accordingly, the sides and ends 10*a*, 10*b* of the monolithic dock (which include an outer and vertical portion of each of the corner members 12, those side members 14 that are vertically disposed and along the sides which include the side members 14 and a first side member 14*a* as is described in greater detail hereinafter, and the J-shaped members 16), and the top or upper surface of the monolithic dock 10 (which include a remaining upper and horizontal portion of each of the corner members 12, those side members 14 that are horizontally disposed along the upper surface (i.e., which form the decking), and the upper surface of the channel member 18) are all formed of the HDPE synthetic material, which thereby provides a consistent and beautiful appearance to the monolithic dock 10. Additionally, once the monolithic dock 10 is placed in the water, the HDPE synthetic material will extend down into and below a waterline 25 (FIG. 3).

The visible exterior of the monolithic dock 10 (with the exception of the cleats 24, hinges 22, and other optional add-on components) is entirely comprised of the synthetic material. This provides an exterior shell or "exoskeleton" that is formed entirely of HDPE material. For the purpose of this specification, the term "exoskeleton" includes all of the corner members 12, side members 14 (and a first side member 14*a*, as is later described in greater detail), J-shaped members 16, and channel members 18 that comprise the monolithic dock 10. This provides an exceptionally attractive appearance. Also, the synthetic decking material is impervious to water penetration. It also resists infestation and damage by barnacles or other marine factors.

For the purpose of this disclosure when it is mentioned that any component is disposed on an inside of the monolithic dock 10, that means the component referred to is disposed on an interior of the synthetic material exoskeleton.

By having the exterior (i.e., the exoskeleton) formed of the synthetic decking material and by having the synthetic decking material extend down below the waterline 25, it also eliminates a space, common with prior art types of docks, that is disposed under the prior art type of dock and above the waterline 25. Therefore, unlike prior art designs, there can be no possible unsightly viewing of billets with the monolithic dock 10 because of the way the sides of the monolithic dock 10 extend down below the waterline 25 and also because the monolithic dock 10, as is described in greater detail hereinafter, does not rely upon a plurality of billets for floatation as do the prior art types of docks.

Also, with prior art types of wooden docks, the wooden frame would rapidly deteriorate if a portion of it were immersed for extended periods of time in the water. However, the synthetic decking material, as used with the monolithic dock 10, can include portions that are disposed both in the water (salt or fresh water) and also above the waterline 25 and still maintain its excellent appearance over an especially long and extended period of time when compared with the prior art designs.

Referring again to FIG. 2, is shown in cross-section a portion of the fabricated monolithic dock 10 but with the side members 14 separated slightly from each other and from the corner member 12 to better illustrate assembly, as is described in greater detail hereinafter. During assembly there would, of course, be no space between these components.

The corner member 12 is built to be more substantial and stronger than the side members 14 for a variety of reasons. A primary reason is that the corner member 12 is used to secure the cleats 24 and hinges 22 to the monolithic dock 10. Therefore, the corner member 12 must be able to withstand greater forces that are transmitted to it by the cleats 24 and hinges 22.

Additionally, the corner member 12 includes a protruding portion, identified by bracket 26 that extends away from the first side member 14*a* that is disposed under it. The first side member 14*a* is identical in structure with the side members 14. It is given a unique reference numeral to better describe its unique placement as being disposed immediately under the corner member 12. When boats approach the monolithic dock 10, they make contact with the protruding portion 26 of the corner member 12. Accordingly, the corner member 12 must also be able to withstand contact and even light impact from the boat as it approaches.

The corner members 12 along the longitudinal sides of the monolithic dock 10 extend (i.e., protrude) from the first side member 14*a* for the reasons mentioned above. However, the corner members 12 that are disposed at the opposite ends 10*a*, 10*b* are oriented so that they are preferably flush (i.e., even) with the side member 14 (not shown) that is disposed at the first end 10*a* and even with a second side member 14*b* that is disposed at the second end 10*b*. This allows for better coupling (i.e., joining) of the monolithic dock 10 to other sections of the monolithic dock 10 or to a supporting structure such as a pier or walkway.

Also, when a person is stepping onto or off of the boat the person will step on the protruding portion 26. Accordingly, it must be able to withstand the greater loading that is experienced as a cantilever that extends outward and away from the corresponding side members 14 that are disposed under it.

The first side member 14*a* extends longitudinally along the length of the monolithic dock 10 from the first end 10*a* to the second end 10*b*. It is cut with a 45 degree miter at both ends. Each of the miter ends mate with a corresponding 45 degree miter end of the side member 14 that is disposed at the first end 10*a* and which is perpendicular to the first side member 14*a* and with the second side member 14*b* that is disposed at the second end 10*b* and which is also perpendicular to the first side member 14*a*.

The side members 14, corner members 12, and J-shaped members 16 all include 45 degree miter ends. It is important to note that it is not necessary to secure any of these components together with fasteners at the miter ends. During manufacture of the monolithic dock 10 securement of all of the exoskeleton components together is accomplished automatically. This is described in greater detail hereinafter and it provides a novel method of fabrication that is both quick and strong without reliance on fasteners.

Additional side members 14 that are parallel with the first side member 14*a* and with the second side member 14*b* continue around the perimeter of the monolithic dock 10, thereby completing a first course of the side members 14, 14*a*, 14*b* that are disposed around the monolithic dock 10 and just below the corner members 12.

Depending on the size of the monolithic dock 10, how high above the waterline 25 an upper surface (i.e., the top surface of the corner members 12 and the top surface of the side members 14 that are used to form the horizontal decking material) is intended to be, and the size of the vessels that are to use the monolithic dock 10 will determine how many courses of side members 14 are needed under the corner members 12.

An interior volume of the monolithic dock 10 (i.e., the volume in the exoskeleton) will include floatation, as is described in greater detail hereinafter. Therefore, as the volume of the monolithic dock 10 increases, so too will the available floatation. In this manner, any desired height above the waterline 25 for the upper surface can be provided.

FIG. 1 shows three courses (i.e., layers) of the side members 14 that extend all around the monolithic dock 10. The number of courses of the side members 14 can be as small as zero (i.e., no course of the side members 14 is required if only one course of the J-shaped members 16 are instead used directly under the corner members 12) or it can be as large (i.e., as many courses of the side members 14) as is required in order to achieve the desired size of the monolithic dock 10 and height of the upper surface.

The corner member includes a preferred cross-section as shown that includes a generally planar horizontal lower corner member side 31. The corner member side 31 includes a lower corner member surface 32. A bottom surface of the protruding portion 26 aligns with the lower corner member surface 32.

A plurality of spaced-apart grooves 34 extend from the lower corner member surface 32 and are included in the lower corner member side 31. Referring momentarily to the first side member 14*a* that is disposed below the corner member 12, the first side member 14*a* includes a generally planar upper side 35. The upper side 35 includes an upper side member surface 36 that, when the first side member 14*a* is urged against the corner member 12 during assembly, abuts the lower corner member surface 32.

Each of a plurality of spaced apart protrusions 38 extend away from the upper side member surface 36 and enter into a corresponding one of a the space-apart grooves 34 of the lower corner member side 31 of the corner member 12. This type of fit is known in the woodworking arts as a "tongue and groove joint".

If desired, another well-known type of joint that is commonly used in the woodworking arts can be used instead of the tongue and groove joint and that type of joint is called a "dovetail" connection in which a generally trapezoidal shaped dovetail would extend away from the upper side member surface 36 (instead of the protrusions 38) and enter into a similarly shaped groove in the lower corner member surface 32 of the corner member 12.

Wherever the tongue and groove fit is used, the dovetail connection could alternately be used. The remainder of the specification will describe manufacture using the tongue and groove construction as is shown herein. It is to be understood that dovetail or other types of a joint connection are also possible.

The advantage of the tongue and groove is that assembly is quicker because the individual components of the monolithic dock 10 need only be pushed together to make the necessary connection (i.e., so they are adjacent to each other) during manufacture. After manufacture the retention of these components together (i.e., what maintains them in a side by side orientation) is accomplished by the foam, as is described in greater detail hereinafter.

The advantage of the dovetail is that, once assembled, the components cannot be urged directly apart from each other. This lessens reliance on the foam for this function. The disadvantage of the dovetail is that, in order to assemble the monolithic dock 10 with dovetail connections, each member must first be aligned at a longitudinal end thereof and urged along its entire longitudinal length so that the dovetail fit engages along the full length of each member (component). This increases the time of manufacture.

The tongue and groove joint includes a male portion which is the tongue and a female portion which is the groove. This type of fit is repeated with the various components of the exoskeleton. These will be referred to as either the male or the female portion of the tongue and groove connection hereinafter and the structure that is used will be identical to that previously described for the corner member 12 and for the first side member 14*a*. A preferred arrangement is described, however, it will be possible to reverse the location of the male and female components or make other changes as desired after having had benefit of the instant disclosure.

The corner member 12 includes a generally square or rectangular shape. The female portion is disposed at the bottom as the various corner members 12 extend around the upper perimeter of the monolithic dock 10.

The corner member 12 includes an outer vertical corner member side 40 that is disposed perpendicular to the lower corner member surface 32. A lower edge of the corner member side 40 is attached to and is adjacent to an outside edge of the lower corner member side 31.

The corner member 12 includes a horizontal upper corner member side 41 that is attached to and disposed perpendicular to the corner member side 40. The upper corner member side 41 includes a horizontal corner member surface 42 that forms a horizontal surface for stepping on when stepping onto or off of a vessel (i.e., boat). An outer edge of the horizontal upper corner member side 41 is attached to an upper edge of the corner member side 40.

The corner member 12 includes a vertical inside corner side 43 that is attached to an inner edge of the horizontal upper corner member side 41. The vertical inside corner side 43 extends downward away from the upper corner member side 41. The inside corner side 43 includes an inside surface 44 that is disposed parallel to the corner member side 40 and which is distally disposed therefrom. The plurality of grooves 34 are again included in the inside corner side 43 and they extend into the inside corner side beginning from the vertical corner member inside surface 44.

Accordingly, the corner member 12 will always present a horizontal female connection at its lower corner member surface 32 and also a vertical female connection at its corner member inside surface 44 regardless of which side or end 10*a*, 10*b* of the monolithic dock 10 that it is disposed.

The corner member 12 includes a first enlarged section 46, a second enlarged section 48, a third enlarged section 50 and a fourth enlarged section 52 disposed on an interior that are formed of the same synthetic material that the corner member 12 is comprised of. The first enlarged section 46 is part of the lower corner member side 31. The second enlarged section 48 is part of the lower corner member side 31 and also part of the vertical corner member side 40. The third enlarged section 50 is part of the vertical corner member side 40 and also part of the upper corner member side 41. The fourth enlarged section 52 is part of the upper corner member side 41.

The enlarged sections 46-52 thereby add considerable strength to the corner member 12 and they also provide a surface to receive screws 54 that are used to mount the cleats 24 and other components. It is important to note that the fasteners (i.e., the screws 54) that are used with the monolithic dock are optional. It is especially important to note that fasteners are not used or required in order to assemble or retain any of the exoskeleton (i.e., the synthetic material members 12, 14, 16, 18) together.

The corner member 12 includes an inside flat surface 56 that is disposed between the second enlarged section 48 and the third enlarged section 50.

A first generally V-shaped channel 58 is provided between the first and second enlarged sections 46, 48 and a second generally V-shaped channel 60 is provided between the third and fourth enlarged sections 50, 52.

A first inward protruding member 62 is attached to an end of the vertical inside corner side 43 and extends inward toward the vertical corner member side 40. Its use is described hereinafter.

Referring again to the first side member 14*a*, the upper side 35 includes the male connection that mates with the female connection of the corner member 12 or with a female connection that is included with any other side member 14, as is described in greater detail hereinafter.

The first side member 14*a* includes an opposite side member 64 that is disposed parallel to the upper side 35 and distally disposed therefrom. The opposite side member 64 includes a lower opposite surface 66 that includes the spaced-apart grooves 34. Accordingly, the opposite side member 64 includes the female connection. Therefore, one end of the first side member 14*a* (and all side members 14) includes a male connection and the opposite side includes a female connection. This allows the joining of as many side members 14*a*, 14*b*, 14 adjacent to each other as is desired.

The upper side 35 includes a second inward protruding member 68 that extends inward from the upper side 35 and the opposite side member 64 includes a third inward protruding member 70 that extends inward from the opposite side member 64.

The first side member 14*a* includes a generally T-shaped member 72 that is attached at a bottom end thereof to an intermediate section 74 of the first side member 14*a*. The intermediate section 74 extends from the upper side 35 of the first side member 14*a* to the opposite side member 64 and is attached to each.

The length of the T-shaped member 72 is preferably greater than the length of the upper side 35 or the opposite side member 64. The length of the upper side 35 and of the opposite side member 64 are the same. Therefore an inside surface 76 of the T-shaped member 72 is disposed further away from the intermediate section 74 than is any portion of the second inward protruding member 68 or the third inward protruding member 70.

The structure of the first side member 14*a* is the same as the remaining side members 14. Each side member 14*a*, 14*b*, 14 that is disposed below the corner member 12 is cut to the desired overall length and a 45 degree miter is provided at its opposite ends. Each side member 14 that is disposed on top of the monolithic dock 10 and intermediate the corner members 12 is flush cut to the desired length so that it abuts the corner members 12 that are disposed at the first end 10*a* and the second end 10*b*.

The intermediate sections 74 of the side members 14 on top of the monolithic dock 10 form the upper surface of the monolithic dock 10. The upper surface that is formed is parallel with the top surface of the corner members 12 and the top surface of the side members 14.

As shown, the side members 14 are disposed so that they extend longitudinally from the first end 10*a* to the second end 10*b*. It is also possible to dispose the side members 14 on top of the monolithic dock 10 perpendicular to that as shown so that they extend across the width thereof.

Accordingly, if the side members 14 on top of the monolithic dock 10 are disposed across the dock 10 (rather than longitudinally) they are each flush cut to width of the monolithic dock 10 so that their overall length is equal to the distance across the dock 10 between the corner members 12.

This alternate orientation allows for shorter lengths of the uppermost side members 14 which may allow the use of scrap material that remains after cutting the side members 14 that are disposed below the corner members 12 has occurred. The shorter pieces are also easier to handle.

This orientation also provides for a slight space to occur between each of the side members 14 that form the upper surface (i.e., the deck) of the monolithic dock 10 where they are joined together (i.e., where they abut each other). Because many pieces of the side members 14 are required, the cumulative space is considerable. This accumulated space is useful in controlling thermal expansion and limiting the amount of bow (i.e., flex) that occurs in the monolithic dock 10 as a result of expansion due to heating and contraction due to cooling.

An advantage to disposing the uppermost side members 14 as shown is that fewer cuts are required. This further decreases the already short time of assembly. Another advantage is that a longitudinal orientation favors the inclusion of utility services, such as electrical or plumbing conduit as is described in greater detail hereinafter.

Figure 4:
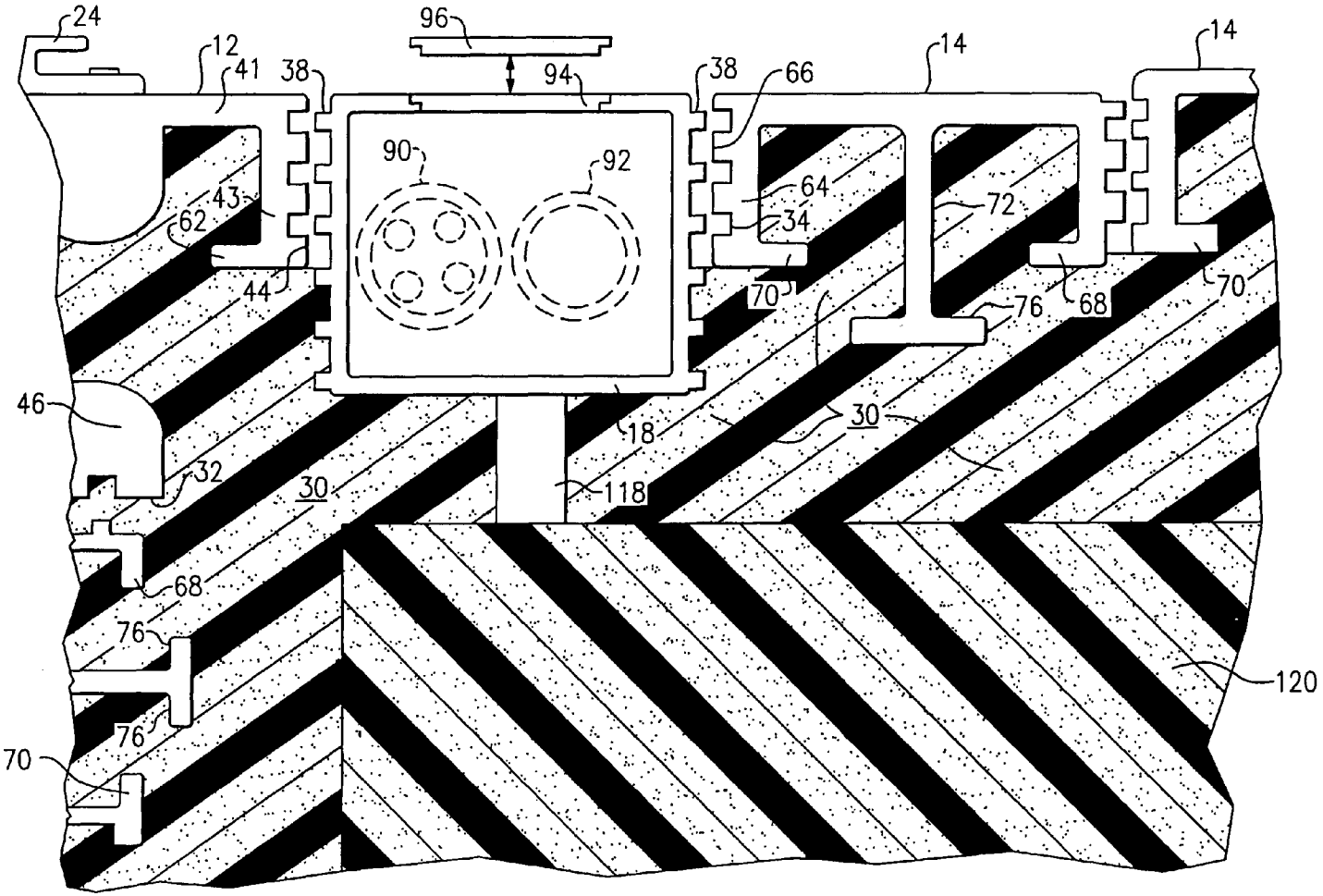
FIG. 4 is a cross-sectional view taken on the line 4-4 in FIG. 1 with the components thereof shown in a slightly exploded view to better illustrate detail of construction.

As shown in FIG. 2, FIG. 3, and FIG. 4 as many of the side members 14*a*, 14*b*, 14 as are needed are included along the upper surface of the monolithic dock 10 or along the vertical sides thereof.

Referring now in particular also to FIG. 3 is shown in cross-section a continuation of the cross section of FIG. 2 and extending lower to also include a cross-section of one of the lower J-shaped members 16. The J-shaped members 16 are a preferred lower termination (i.e., bottom) of the monolithic dock 10. If desired, it is possible to use a side member 14*a*, 14*b*, 14 as the lower termination.

The J-shaped members 16 extend around the bottom perimeter of the monolithic dock 10. Each end of each of the J-shaped members 16 is cut at a 45 degree miter and abuts a corresponding one of the J-shaped members 16 at a corresponding miter.

The J-shaped member 16 includes an upper male connection, identified in general by the reference numeral 78, which is identical to the upper side 35 and the second inward protruding member 68 of the side members 14*a*, 14*b*, 14. The J-shaped member 16 includes the T-shaped member 72 disposed at a bottom of a vertical side portion, identified by bracket 80, of the J-shaped member 16.

The J-shaped member 16 includes an inward radius, identified by bracket 82 that begins below the T-shaped member 72 and which extends downward until it terminates at a fourth inward protruding member 84. The fourth inward protruding member 84 extends upward toward the upper male connection 78.

The inward radius 82 of the J-shaped member provides two unexpected benefits and therefore serves two important purposes. First, it is disposed in the waterline 25. Accordingly, when the water freezes and pushes inward on the monolithic dock 10, the increasing pressure (i.e., inward force) is experienced by the inward radius 82. A portion of the inward force produces a vector that tends to urge the entire monolithic dock 10 upward.

Accordingly, when the water freezes, the monolithic dock 10 is automatically raised a sufficient amount in an upward direction so as to prevent damage to the monolithic dock 10 from freezing. When the water thaws, the monolithic dock naturally descends back into the water. This process occurs automatically every time the water freezes and thaws. This allows use of the monolithic dock in waters that are subject to freezing.

It is important to note that the low weight of the monolithic dock 10 in combination with the J-shaped members 16 is necessary for this benefit to occur. If, for example, the inward radius 82 of the J-shaped members 16 were somehow to be retrofitted for use with the substantially heavier prior art type of dock it would not rise during freezing of the water an amount sufficient to prevent damage to the prior art dock from occurring. This is because the upward force vector provided by the J-shaped member would be insufficient to counteract the great weight of the prior art type of dock.

A second unexpected benefit provided by the inward radius 82 of the J-shaped members 16 is that it tends to deflect a cross current, as shown by arrow 86. The inward radius 82 helps to direct the cross current 86 under the monolithic dock 10. This lessens the magnitude of force that the cross current 86 would otherwise exert upon the monolithic dock.

It is important to note that because the monolithic dock 10 is especially light and displaces water over a large surface area it requires only a minimal amount of draft, as shown by bracket 88. The lesser the draft 88 that is required, the lesser will be the amount of the monolithic dock 10 that is disposed in the water. The small draft 88 substantially decreases the effect of the cross current 86 by proportionately decreasing the force exerted on the monolithic dock 10 by the cross current 86.

The low draft 88 combined with the deflecting ability of the inward radius 82 of the J-shaped members 16 allows use of the monolithic dock 10 where strong cross currents 86 are possible, such as in rivers. Accordingly, the monolithic dock 10 can be used in cross currents 86 that would be far too strong for other prior art types of docks.

Figure 6:
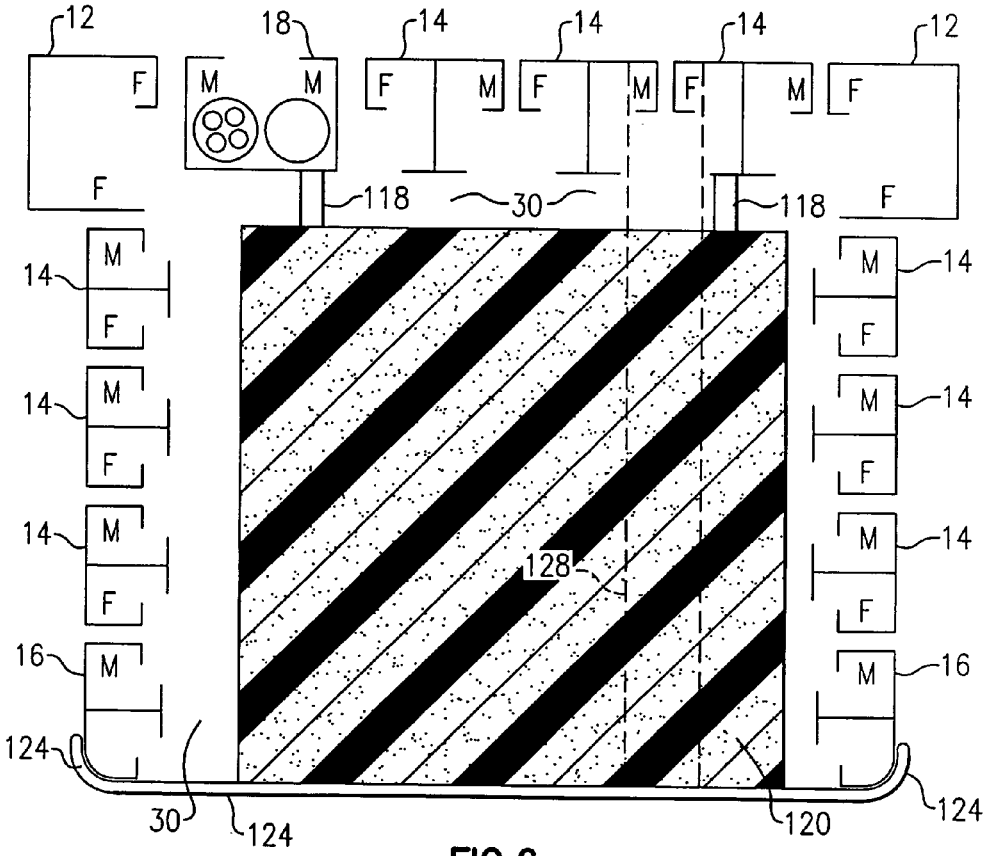
FIG. 6 is a simplified cross-sectional view taken on the line 6-6 in FIG. 1 with the components thereof shown to illustrate the male and female orientation of each.

Referring now primarily to FIG. 4 and also to FIG. 6, is shown a cross-section of the monolithic dock taken on the opposite side of the monolithic dock 10. The channel member

18 extends the longitudinal length of the monolithic dock 10 up to the corner members 12 at the first and second ends 10*a*, 10*b*.

The channel member 18 includes a male connection on both sides. This is necessary because the corner member 12 that wraps around the upper perimeter of the monolithic dock 10 includes only female connections. Therefore, one longitudinal component is required to include a male-to-male connection providing the side members 14 used for decking the upper surface are disposed in a longitudinal orientation, as shown.

If, however, the side members 14 that comprise the upper surface are disposed across the monolithic dock 10 they would be flush-cut on both ends and they would extend from the corner member 12 to the channel member 18.

The channel member 18 is optionally included to provide an opening in which utilities can be included. The utilities most commonly used are electricity and water. Sewer is usually run through a separate line, however if desired, sewer could also pass through the channel member 18.

As shown in dashed lines, an electrical conduit 90 includes a plurality of electrical wires therein. A water conduit 92 supplies water under pressure.

An opening of sufficient size is provided (i.e., cut or formed during manufacture) at the first end 10*a* and at the second end 10*b* to permit continuation of the electrical conduit 90 and the water conduit 92 to additional monolithic docks 10, if they are included.

It is necessary to access the electrical conduit 90 and the water conduit 92 to break the utilities to the upper surface of the monolithic dock 10 for use where desired and for electrical connections, etc.

It is possible to accomplish this by providing an opening 94, where desired, in the channel member 18. A removable lid 96 is removed to allow access and is secured in place when access is not required. The lid 96 may be secured by screws (not shown) or by friction fit or it may be hinged, as desired. When access is provided, this is known as a "sunken vault".

It is also possible to provide a separate box 98 (FIG. 1) that is disposed where desired along the longitudinal length of the monolithic dock 10. The separate box 98 includes the removable lid 96 and functions as the sunken vault. The channel member 18 abuts the separate box 98 on both ends thereof to provide a continuous longitudinal opening for the electrical conduit 90 and the water conduit 92. As many sunken vaults are provided as is desired.

If desired, other accessory items can be provided that attach to the separate box 98 (or other specially designed boxes). For example, a light post 100 can be provided that includes an electrical duplex receptacle 102 (i.e., outlet).

The cross-sectional shape of the corner member 12, side member 14, J-shaped member 16, and channel member 18 is preferred for the monolithic dock 10. These unique profiles are important and provide substantial improvement to the structural strength and therefore, the durability and utility of the monolithic dock 10.

Figure 7:
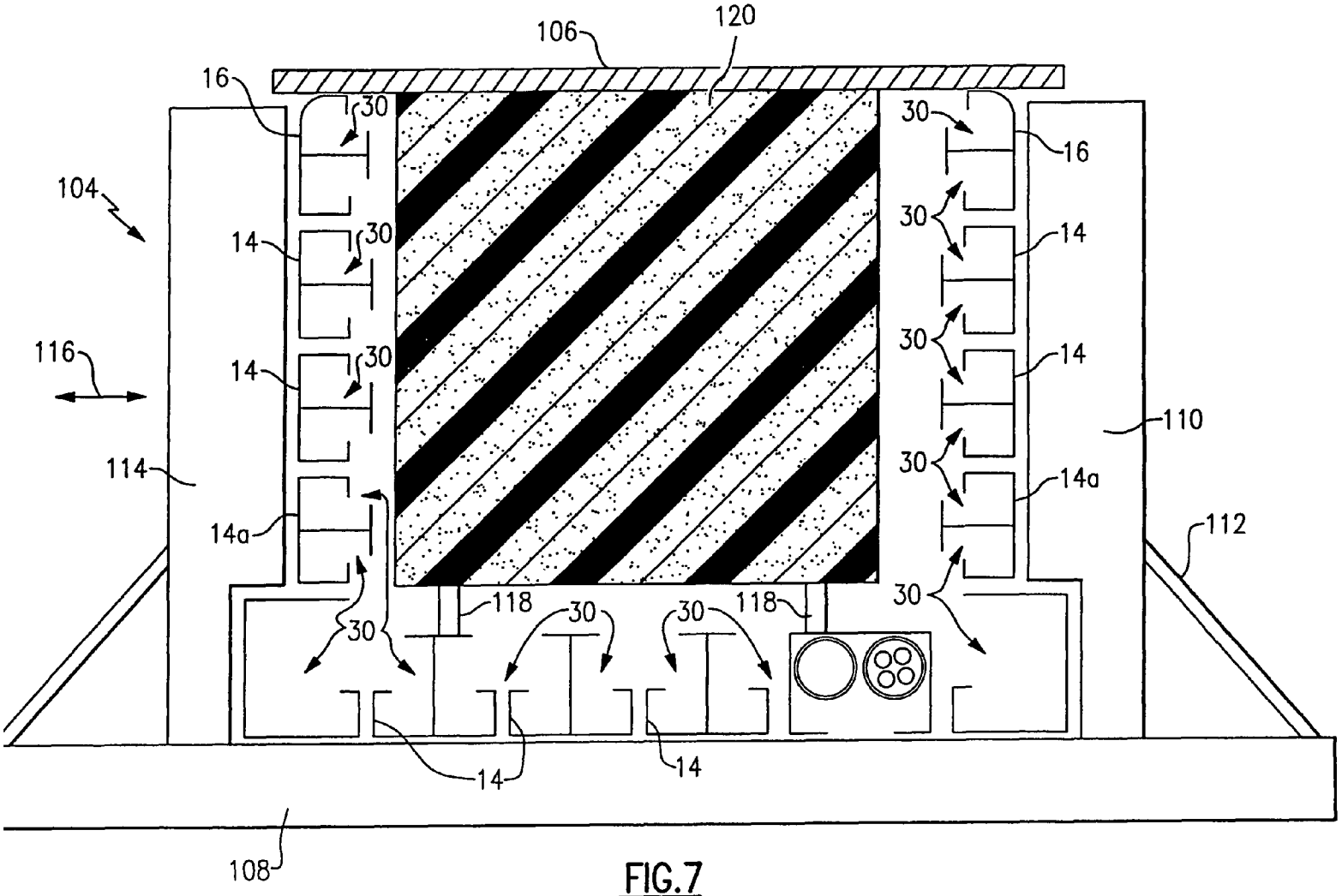
FIG. 7 is a simplified cross-sectional view taken on the line 6-6 in FIG. 1 during manufacture of the monolithic dock with a manufacturing frame assembly and a manufacturing top plate included and the monolithic dock shown in an upside-down orientation.

To understand the importance of the cross-sectional shape of the components used in the exoskeleton (i.e., the corner member 12, side member 14, J-shaped member 16, and channel member 18) it is necessary to understand further how these components are secured together. For this it is helpful to refer also to FIG. 7 which shows a manufacturing frame assembly, identified in general by the reference numeral 104 and a manufacturing top plate 106.

The manufacturing frame assembly 104 includes a base assembly 108 and a fixed side assembly 110, both of which extend beyond the width and length of the monolithic dock 10. Gussets 112 are included as needed. A sliding side assembly 114 is adjustable in the direction as shown by arrow 116 to accommodate the desired width of the monolithic dock 10. The height shown is to accommodate the height shown in the drawing figures. The height is also adjustable to accommodate any desired height of the monolithic dock 10. The manufacturing frame assembly 104 includes a similar fixed end side assembly (not shown) and an adjustable end side assembly (not shown) that similarly support the first end 10*a* and the second end 10*b* of the monolithic dock during manufacture. The manufacturing frame assembly 104 is adjusted for the desired size of the monolithic dock 10.

Then, the two corner members 12 that comprise the longitudinal sides are cut with 45 degree miters at the end. The two corner members 12 that are disposed at the first end 10*a* and at the second end 10*b* are cut to the desired width, again with 45 degree miters. They are simply placed in the frame assembly at the bottom. Accordingly, the monolithic dock 10 is preferably manufactured upside-down.

Then as many of the side members 14 as are required for to width are also flush-cut to length and are placed on the base assembly 108 between the corner members 14. If included, the channel member 18 is also similarly cut to size and included. The electrical conduit 90 and the water conduit 92 are installed either before assembly or afterward.

Then, the first course of the side members 14*a* (FIG. 7) are cut to length and with a 45 degree miter. They are placed on top of the corner members 12 with the male and female connections being made. Then, the next two courses of the side members 14 are similarly cut and placed on top of the first course. The overall length of the side members 14*a*, 14 will be less than that of the corner members 12.

Finally, the J-shaped members 16, which are the same length as the side members 14, are cut and are placed on top of the final course of the side members 14. This completes the components that comprise the exoskeleton.

It is important to note that no fasteners are required to secure the corner members 12, side members 14, J-shaped members 16, and channel members 18 together, thereby saving an incredible amount of time and also the cost of the fasteners. These components are merely cut to size and placed in the manufacturing frame assembly 104.

Then the urethane foam 30 is activated for use by combining the catalyst as is well known in the urethane foam arts. A reasonably slow acting urethane foam 30 is generally preferred that is commonly poured where desired.

However, it is preferred to spray the activated urethane foam 30 so that the inside of the corner members 12, side members 14, J-shaped members 16, and channel members 18 are properly wetted with the urethane foam 30.

Spacers 118 are placed on certain of the lower side members 14 or on the channel member 18 where desired either before spraying the urethane foam 30 or immediately afterward. The spacers 118 are used to support a STYROFOAM™ block 120 that is cut to size and is placed on top of the spacers 118 after the urethane foam 30 has first been applied (i.e., sprayed) and before it begins to expand and form an expanded cellular structure common with the cured urethane foam 30.

A plurality of the STYROFOAM™ blocks 120 may also be used, as desired. STYROFOAM™ is a type of expanded polystyrene. The STYROFOAM™ blocks 120 are placed along the longitudinal length and in an interior of the monolithic dock 10 to provide floatation and also to fill the bulk of the volume therein. This requires the use of considerably less of the urethane foam 30 than would otherwise be required. This is desirable for two reasons.

First, the urethane foam 30 cost considerably more than does the STYROFOAM block 120. Second, the urethane foam 30 expands as it cures and then it contracts slightly. The magnitude of contraction is a function of the quantity of the urethane foam 30 that is used. If the entire interior volume of the monolithic dock 10 were formed of the urethane foam 30, which is of course possible, the monolithic dock 10 would develop a bow after curing was complete because contraction would pull all of the components (i.e., the synthetic material components including the corner members 12, side members 14, J-shaped members 16, and channel member 18) toward each other. The manner in which the urethane foam 30 secures itself to the synthetic material is described in greater detail hereinafter.

Therefore, use of the STYROFOAM block 120, which has already cured and therefore does not experience any contraction, minimizes the effects of contraction during curing of the urethane foam 30. This results in less bowing of the monolithic dock 10.

The STYROFOAM block 120 preferably is cut to size so that an edge of it aligns with a line across the J-shaped members 16 (i.e., where the manufacturing top plate 106 is disposed) when it is placed on top of the spacers 118.

The manufacturing top plate 106 is preferably made of steel or other suitable material. It is placed on top of the J-shaped members 16 and it overlaps them. If the manufacturing top plate 106 is not sufficiently heavy, weight is added on top of the manufacturing top plate 106. Alternately, the manufacturing top plate 106 can be positioned by a hydraulic actuator or other means, if desired.

As the urethane foam 30 reacts chemically, it begins to expand and to fill the voids between the corner members 12, side members 14, J-shaped members 16, and channel member 18. It also pushes against the STYROFOAM block 120 from all sides and also upward against the manufacturing top plate 106. The preferred formulation for the urethane foam 30 begins to expand in a few minutes after spraying. It expands fully and cures in approximately 30 minutes. Other formulations and times are also possible but this particular formulation provides ample working time and also good throughput in the production of the monolithic docks 10 as well as an especially strong and durable urethane foam 30.

A small amount of excess urethane foam 30 may escape out between the manufacturing top plate 106 and the J-shaped members 16. This excess is later trimmed with a knife and removed after the manufacturing top plate 106 has been removed.

As the urethane foam 30 cures and expands, the entire volume inside the monolithic dock 10, less that taken up by the STYROFOAM™ block 120 and the cross-sectional volume of the corner members 12, side members 14, J-shaped members 16, and channel member 18, is filled with the urethane foam 30. Once cured, the urethane foam 30 secures all of the component parts that form the synthetic material exoskeleton (i.e., the corner members 12, side members 14, J-shaped members 16, and channel member 18) together into a monolithic structure. No fasteners are required. A unified structure is provided.

The cross-sectional shape of the corner member 12 ensures that when the void therein is filled with the urethane foam 30 that the urethane foam 30 cannot be pulled out of the corner member 12. Resistance is provided by the urethane foam 30 that is disposed in the first generally V-shaped channel 58 and by the second generally V-shaped channel 60 as well as by the first inward protruding member 62. The cross-sectional profile extends along the entire longitudinal length of the corner member 12 thereby providing substantial holding power to secure the urethane foam 30 to the corner member 12. This continues fully around the monolithic dock 10.

The cross-sectional shape of the side member 14 similarly ensures that when the two voids therein are filled with the urethane foam 30 that the urethane foam 30 cannot be pulled out of the side member 14. Resistance is provided by the urethane foam 30 that is disposed in the two voids.

It is especially important to note that the second inward protruding member 68 and the third inward protruding member 70 are generally on a line 122 (see dashed line, FIG. 3) and that the inside surface 76 of the T-shaped member 72 is disposed away from the line 122, further inward toward a geometric center of the monolithic dock 10.

This is important because certain types of the HDPE synthetic material are especially slippery. Virtually no glue or material bonds well to this material which tends to exude an oily film on its surface. Therefore, the second inward protruding member 68, the third inward protruding member 70 and the inside surface 76 of the T-shaped member 72 provide retention surfaces that are generally parallel with the outside of the side member 14. These surfaces prevent the urethane foam 30 that is disposed in the two voids from being pulled away from the side members 14 during contraction. As the urethane foam 30 contracts during the end stages of the curing process even a small amount of contraction over the longitudinal length involved places a substantial amount of force on the urethane foam 30 and upon these portions of the side members 14. During normal use of the monolithic dock 10, there is also expansion and contraction that occurs due to heating and cooling. The urethane foam 30 has a different coefficient of expansion than does the synthetic material. This also subjects the urethane foam 30 to compressive and expansive loading forces.

The urethane foam 30, having a lower tensile strength than the synthetic material, is prone to breakage. That breakage would tend to occur in substantially a straight line across the shortest expanse of urethane foam 30 possible. If the inside surface 76 of the T-shaped member 72 was lower (further toward an exterior of the monolithic dock 10) so that it was parallel with the second inward protruding member 68 and with the third inward protruding member 70 (i.e., on the line 122) then a very short expanse of urethane foam 30 would exist between the inside surface 76 and the second inward protruding member 68 or the third inward protruding member 70. Breakage would be far more likely to occur, resulting in a substantially weaker structure.

If desired, any number of additional T-shaped structures 79 (shown in dashed lines, FIG. 2) are attached to the side members 14 or the J-shaped members 16. Preferably, a T-portion 79*a* of the additional T-shaped structures 79 is disposed at a unique and different distance away from an outside surface of the side member 14 or the J-shaped member 16 for the reasons were mentioned hereinabove.

A similar cross-sectional consideration for the J-shaped member 16 ensures that maximum retention of the urethane foam 30 is provided by the cross-sectional profile of the J-shaped member 16 while maximizing the linear distance (i.e., the expanse) of the urethane foam 30 between the fourth inward protruding member 84 and the inside surface 76 of the T-shaped member 72.

After the urethane foam 30 has fully cured, the sliding side assembly 114 is loosened and urged away from the monolithic dock 10. The monolithic dock 10 is either removed from the manufacturing frame assembly 104 or centered therein for a final manufacturing step. Masking tape (not shown) or another type of protective temporary coating is applied all around the perimeter of the monolithic dock 10 to the J-shaped member approximately over the area covered by bracket 80.

An elastomeric coating 124 is sprayed over the lower portion of the J-shaped member 16 as shown by bracket 82 and over the exposed urethane foam 30 and the exposed bottom of the STYROFOAM™ block 120 on the bottom of the monolithic dock 10. Spraying continues all around the bottom and up the sides of the J-shaped members 16 that are disposed on an opposite longitudinal side and at the first end 10*a* and at the second end 10*b* of the monolithic dock 10.

The elastomeric coating 124 provides a seal that extends above the waterline 25. Accordingly, during use, no water is able to contact any of the urethane foam 30 or the STYROFOAM™ block 120. This is preferable because it denies barnacles and other aquatic life forms access to the urethane foam 30 or the STYROFOAM™ block 120 where they could potentially damage these structures.

The elastomeric coating 124, by preventing water from making contact with either the urethane foam 30 or with the STYROFOAM™ block 120 also helps to avoid the necessity for compliance with a potential US Coast Guard requirement concerning an amount of water that a type of foam floatation can absorb over an extended period of time (i.e., 30 days). Certain types of the STYROFOAM™ block 120 do not satisfy this requirement.

The elastomeric coating 124 allows long term use of the STYROFOAM™ block 120 which provides additional floatation without having to comply with the above-mentioned Coast Guard requirement because the STYROFOAM™ block 120 is not subject to contact with any water during use of the monolithic dock 10.

To better ensure that the elastomeric coating 124 adheres to the J-shaped member 16, a plurality of dovetail retention grooves 126 are formed into the J-shaped member 16 along its longitudinal length. Other ways are possible to provide an enhanced surface by which the elastomeric coating 124 can better grip (i.e., adhere) to the J-shaped member 16 other than the dovetail retention grooves 126. For example, grooves, etchings, cross-hatch patterns, etc. can be used.

When the elastomeric coating 124 is sprayed on the J-shaped member 16, it enters into the dovetail retention grooves 126. The elastomeric coating 124 sets (i.e., cures) and forms a continuous water-impermeable coating (i.e., shell) over the bottom of the monolithic dock 10 and up along the bottom to a location that is preferably disposed above the waterline 25.

The synthetic decking material used to form the corner members 12, side members 14, J-shaped members 16, and channel members 18 can include any preferred color. It is desirable to provide the elastomeric coating 124 in a matching color. Accordingly, the monolithic dock 10 also creates and maintains a uniform appearance from any perspective when in use.

After the elastomeric coating 124 has cured, the monolithic dock 10 is ready for use. It is removed from the manufacturing frame assembly 104 for use. It can be built where needed or built remotely and shipped to where needed.

Typically, the electrical conduit 90 and the water conduit 92 are added at the time the monolithic dock 10 is readied for installation into the water (i.e., in-situ) and attachment to a pier or other structure. However, if preferred the electrical conduit 90 and the water conduit 92 can be included (along with the electrical wiring) at any preferred time during manufacture.

Optional accessories, for example, the light post 100 and the duplex receptacle 102 are typically installed in-situ.

Referring again in particular to FIG. 6, if a spud well 20 is desired for anchorage of the monolithic dock 10, then an opening is cut in the side members 14 that form the upper surface (i.e., the top of the deck) where desired. A pipe 128 (steel or PVC or other, shown in dashed lines) is placed in the opening and cut so that it is flush with the bottom (i.e., up even with the manufacturing top plate 106). An opening for the pipe 128 is also provided in the STYROFOAM™ block 120. When the urethane foam 30 expands it wraps around the pipe 128 and it also enters into the opening provided in the STYROFOAM™ block 120 for the pipe 128. The urethane foam 30 also secures the pipe 128 in position, thereby providing the desired spud well 20.

As many spud wells 20 as are desired can, of course, be included with the monolithic dock 10 during manufacture. Spud wells 20 can also be added later by drilling to provide the opening and by inserting the pipe 128 into the drilled opening. The pipe 128, when it is added after manufacture of the monolithic dock 10 is complete, is retained in place by friction or by the use of an adhesive, or by any preferred fastener that secures the pipe 128 to the monolithic dock 10.

Figure 5:
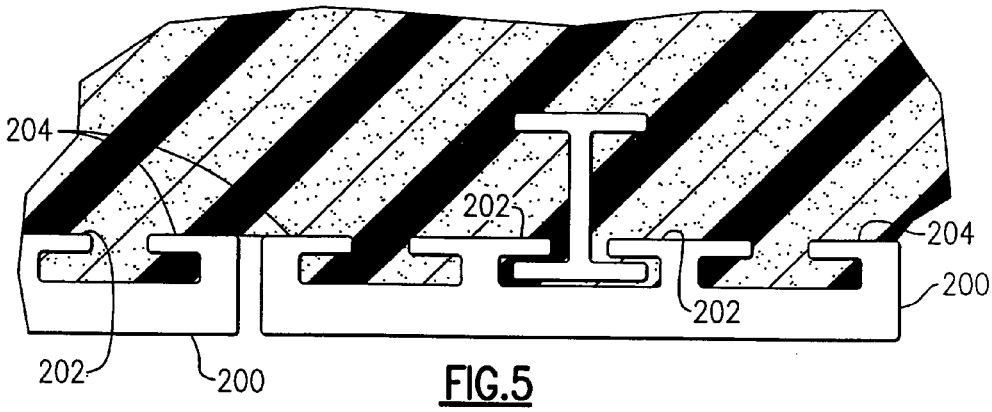
FIG. 5 is a cross-sectional view of a currently available synthetic decking material with an optional member disposed therein to secure the decking material to a foam core.

Referring now to FIG. 5 is shown the cross-sectional profile of an existing type of synthetic decking framing material 200. While it is possible to use the framing material 200 to form the sides and top of the monolithic dock 10, this is not preferred because all of a plurality of generally T-shaped framing members 202 and end members 204 are parallel with each other.

This provides an especially short distance (i.e., expanse) between these components of the framing material 200 which would tend to permit a fracturing of the urethane foam 30 to occur at these areas. It is possible to improve performance of the framing material 200 by including one or more additional T-shaped members 206 that are inserted longitudinally into certain of the openings of the framing material 200 in, a spaced-apart orientation. This would provide additional retention support that is not on the same line as are the framing members 202 and end members 204.

The framing material 200 could be used to function as the near-equivalent of the preferred side members 14. A larger version of the framing material 200 could be used to function as the near-equivalent of the corner members 12.

After having had benefit of the instant disclosure, it is possible to modify virtually any component herein disclosed. For example, if desired, it is possible to use fasteners to secure any of the component parts together for severe duty applications of the monolithic dock 10. It is also possible to include additional reinforcing members that are either disposed within the exoskeleton of the monolithic dock 10 or external to the exoskeleton if additional strength is required, for example, if the monolithic dock 10 is to be used to secure very large vessels and yachts or if especially rough waters are expected.

The monolithic dock 10 provides exceptional torsional and longitudinal stiffness, is lightweight, does not require fasteners that will eventually loosen, has a great appearance that extends down into waterline 25, and has an exceptionally long life expectancy.

The monolithic dock 10 can be built in a fraction of the time required to assemble a conventional type of wooden dock.

The urethane foam 30 in concert with the synthetic material of the exoskeleton provides the unexpected benefit of providing a unified monolithic structure for the monolithic dock 10 that does not need fasteners. The urethane foam 30 also provides the unexpected benefit of acting as an underlayment (i.e., a layer that is disposed immediately under the exoskeleton).

When a vessel impacts the corner member 12 the force exerted on the corner member 12 is transferred to the urethane foam 30 which compresses slightly and then expands. The urethane foam 30 thereby provides energy dampening and attenuation of the forces of impact. This prevents damage and lessens wear of the corner member 12. It also provides a level of resiliency to the monolithic dock 10 that further extends its useful life.

The channel member 18 included the male to male connection. If desired, a modified decking member (not shown) could be included that would be identical to the side member 14 except that it would contain the male to male connection. If desired, a modified corner member (not shown) could include at the top a male connection. The modified corner member would then be used only along one side of the monolithic dock 10. This would eliminate the need for a male to male connection with any of the members 14*a*, 14, 18 that run along the longitudinal length of the monolithic dock 10.

If the side members 14 that form the upper surface (i.e., the decking that is walked on) of the monolithic dock were arranged perpendicular with the longitudinal length of the monolithic dock 10, then the male to male connection would not be necessary.

Of course, it is possible to change the gender of the connection on any member, as desired, providing the corresponding gender of the mating components is also similarly changed. Other connections, besides the dovetail and the tongue and groove are also possible. For example, a "ship-lap" type of connection where a portion of each member overlaps a portion of an adjoining member is also possible.

Referring now to FIG. 8, a preferred hinge plate assembly, identified in general by the reference numeral 300, is attached to the second end 10*b* of the monolithic dock 10.

The hinge plate assembly 300 includes a plate 302 that is secured to the corner member 12 by lag screws 304 that penetrate deeply into the second enlarged section 48 and into the third enlarged section 50. A pair of hinge plates 306 (only one is shown) are attached (i.e., welded) to the plate 302 in a spaced-apart relationship. Each hinge plate 306 includes an opening through which the rod 23*f* passes. The second portion 23*e* is pivotally attached to the hinge plate assembly 300 by the rod 23*f* which passes through openings in both the second portion 23*e* and in the hinge plates 306.

This provides an exceptionally strong way to anchor the hinge plate assembly 300 to the monolithic dock 10 and is generally preferred for use at the first and second ends 10*a*, 10*b*. It may also be used in lieu of the marine dock hinge 23, where desired, when additional strength is required.

It is also possible to include a 4 inch by 4 inch (or other size) beam 308 (shown in dashed lines, made of wood or other material, including HDPE, if desired) in the corner member 12 along the first end 10*a* or the second end 10*b* adjacent to where the hinge plate assembly 300 is located.

The beam 308 provides additional strength to the corner member and can be used to secure the hinge plate assembly 300 by the use of additional fasteners 310 that pass through the hinge plate assembly 300 and enter into the beam 308. The beam 308 preferably extends along the width of the monolithic dock 10 and helps to distribute forces over a greater area.

The beam 308 is used whenever it is desired to provide additional strength for impact from large boats and yachts or to better secure any other type of add-on device (not shown) that is desired for use with the monolithic dock 10. Accordingly, the beam 308 can also be used, where desired, along the longitudinal length (the sides) of the monolithic dock 10.

The beam 308, or beams 308 if a plurality is used, are placed in position before the urethane foam 30 is applied. They are preferably secured in place by any preferred fastener that passes through the corner member 12 and engages with the beam 308 prior to the application of the urethane foam 30.

The use of the beam 308 also teaches that any other desired type of reinforcing member can be included with the monolithic dock 10 in its interior. Of course, additional reinforcing structures can also be secured to an exterior of the monolithic dock 10. However, when a desired type of reinforcing member is attached to an inside of the monolithic dock 10, additional strength is provided that is not visible from the outside, thereby preserving the aesthetic benefits of the monolithic dock 10.

Referring to FIG. 2 and also to FIG. 8 is shown a difference in the positioning of the second side member 14*b* disposed at the second end 10*b* as compared to the first side member 14*a* disposed along a longitudinal side of the monolithic dock 10. An extra spaced-apart groove 34*a* is provided in the corner member 12. The second corner member 14*b* is offset so that it is flush with the outside of the corner member 12.

In this position, the outermost spaced apart protrusion 38 of the second corner member 14*b* fits into the extra spaced-apart groove 34*a*. The interior-most spaced apart protrusion 38 is now unused. In FIG. 2, the extra spaced-apart groove 34*a* was unused. This allows the same corner member 12 as well as the identically-formed first side member 14*a* and second side member 14*b* to be disposed either flush with the corner member 12 at the first and second ends 10*a*, 10*b* or recessed along the longitudinal sides depending upon which of the grooves 34 and the spaced-apart groove 34*a* of the corner member 12 are used.

As briefly mentioned before, it is possible to modify the chemical formulation of the urethane foam 30 to achieve any desired result. For example, the formulation can be modified to provide a slower cure time.

The use of the STYROFOAM™ block 120 lessens the amount of urethane foam 30 that is required. For certain applications the STYROFOAM™ block 120 may be eliminated where only the urethane foam 30 is used. The use of the elastomeric coating 124 may be eliminated, as well, if the resultant urethane foam 30 complies with the appropriate Coast Guard requirements.

It is also possible to place a polyurethane block on top of the STYROFOAM™ block 120 (i.e., on the bottom of the monolithic dock 10) so that no portion of the STYROFOAM™ block 120 is in contact with the water, thereby complying with Coast Guard requirements.

The polyurethane block that is disposed over the STYROFOAM™ block 120 can be preformed and placed over the STYROFOAM™ block 120, if desired, when the urethane foam 30 is being sprayed generally. Alternately, the STYROFOAM™ block 120 can be disposed below the bottom of the J-shaped members 16 (instead of even with them) and an additional quantity of the urethane foam 30 can also be sprayed (or poured) on top of the STYROFOAM™ block 120.

Then the manufacturing top plate 106 is placed on top of the bottom of the J-shaped members 16, as previously described while the urethane foam 30 reacts, expands, and cures. The urethane foam 30 will expand to fill in the volume between the STYROFOAM™ block 120 and the manufacturing top plate 106, set, and cure. Any excess of the urethane foam 30 is then trimmed (i.e., removed) with a knife or bladed tool.

This provides a version of the monolithic dock 10 where the STYROFOAM™ block 120 is entirely encapsulated by the urethane foam 30. The urethane foam 30, being a type of polyurethane, is generally able to satisfy the required Coast Guard requirements. Accordingly, the STYROFOAM™ block 120 is not exposed to contact by water and is therefore immune from compliance with the Coast Guard requirements concerning floatation devices that are in contact with water. If desired, the elastomeric coating 124 can be eliminated or it can be included if added protection is required, for example, from marine inhabitants.

If desired, electrical heating tape or conduit for carrying any preferred type of heating element (not shown) is also added during manufacture, where desired, and prior to spraying (i.e., adding) the urethane foam 30. The electrical heating tape is well known in the plumbing arts and is used to prevent pipes from freezing. If it is placed adjacent to the side members 14 that are used to form the upper decking surface (i.e., just under the uppermost side members 14) then the electrical tape will energize when the temperature nears freezing. This will prevent the upper surface (the deck) from freezing, which promotes safe passage in cold climates. The conduit, if used, can contain the heating tape which can be easily replaced when necessary.

Similarly, electrical tape can be placed alongside the J-shaped members 16 proximate the waterline 25 or, if J-shaped members 16 are not used, alongside the side members 14*a*, 14. This is useful in preventing the formation of ice at the waterline 25, which further lessens the likelihood of damage occurring to the monolithic dock 10 as a result of it being in waters that are subject to freezing.

By using or matching the components that are used to form the monolithic dock 10 with commercially available decking, the monolithic dock 10 can match the appearance (color, texture) of piers, ramps, and walkways. This provides a unified and pleasing aesthetic appearance, not previously available with prior art types of docks, that extends from below the waterline 25 to those structures that are elevated above the waterline 25.

It is also possible to use other materials (than the HDPE) to form the component parts of the monolithic dock 10 while still incorporating the teachings and many benefits as disclosed herein. For example, low density polyethylene (LDPE), polyvinyl chloride (PVC), and even aluminum can, instead, be used in place of the synthetic decking members.

Various types of foam, other than urethane, can be used if desired. For example expanded polystyrene foam (EPS) can be used. Styrene beads are poured or sprayed where desired and then subjected to steam which causes them to expand (i.e., puff) and bond together to form the EPS. This is not generally preferred but may be used where it is deemed to be suitable.

It is also possible to use the monolithic dock 10 as a swim platform, if desired.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method for making a monolithic dock, comprised of the steps of:

(a) placing a plurality of members in a desired position adjacent one-another, and wherein said plurality of members are used to form side, ends, and an upper surface of the dock, and wherein when the plurality of members are disposed in their respective positions they form an exoskeleton of the dock;

(b) pouring or spraying a foam to an inside surface of said plurality of members, wherein said inside surface of said plurality of members is disposed in an interior of said exoskeleton; and (c) allowing a sufficient amount of time for said foam to cure an amount that is sufficient for said foam to engage with a cross-sectional profile of at least some of said plurality of members and wherein said foam engages an amount that is sufficient to secure said plurality of members to said foam and, wherein said foam is able to secure and retain said plurality of members in a desired relative position with respect to one-another sufficient to form said exoskeleton and provide floatation sufficient to permit the dock to float when placed in the water.

2. The method of claim 1 including the step of placing said plurality of members in a frame assembly prior to the step of applying said foam.

3. The method of claim 2 including the step of applying a plate over an open bottom of said monolithic dock prior to the step of allowing said foam to cure.

4. The method of claim 1 including the step of applying a quantity of expanded polystyrene to an interior of said monolithic dock after the step of applying said foam and prior to the step of allowing said foam to cure.

5. The method of claim 1 including the step of applying an elastomeric coating over a bottom of said monolithic dock after the step of allowing said foam to cure.

6. The method of claim 1 wherein the step of applying a foam includes the step of pouring said foam onto said members or alternately the step of spraying said foam onto said members.

7. The method of claim 1 wherein the step of applying a foam includes the step of applying a urethane foam.

* * * * *